US011548296B2

(12) United States Patent
Greive et al.

(10) Patent No.: US 11,548,296 B2
(45) Date of Patent: Jan. 10, 2023

(54) PRINTING MACHINE WITH AN INKJET PRINTING HEAD, A RADIATION DRIER AND AT LEAST ONE LIGHT TRAP

(71) Applicant: HEIDELBERGER DRUCKMASCHINEN AG, Heidelberg (DE)

(72) Inventors: Martin Greive, Schriesheim (DE); Ernst-Christian Maschler, Heidelberg (DE); Michael Kohlmann, Frankenthal (DE); Markus Wolf, Heidelberg (DE); Sibel Korkut Punckt, Stutensee (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 381 days.

(21) Appl. No.: 16/512,989

(22) Filed: Jul. 16, 2019

(65) Prior Publication Data

US 2020/0039244 A1 Feb. 6, 2020

(30) Foreign Application Priority Data

Jul. 31, 2018 (DE) ..... 102018212730.1

(51) Int. Cl.
*B41J 11/00* (2006.01)
*B41M 7/00* (2006.01)

(52) U.S. Cl.
CPC ..... *B41J 11/00214* (2021.01); *B41M 7/009* (2013.01); *B41M 7/0081* (2013.01); *B41J 11/0022* (2021.01)

(58) Field of Classification Search
CPC . B41J 11/002; B41J 11/00214; B41J 11/0022; B41J 2/14; B41J 2/01; B41M 7/0081; B41M 7/009
USPC ..... 347/102
See application file for complete search history.

(56) References Cited

U.S. PATENT DOCUMENTS

| | | | |
|---|---|---|---|
| 4,024,548 | A | 5/1977 | Alonso et al. |
| 8,326,183 | B2 | 12/2012 | Petermann |
| 8,668,328 | B2 | 3/2014 | Ray et al. |
| 9,636,928 | B2 | 5/2017 | Noell |
| 9,937,734 | B2 | 4/2018 | Beier et al. |

(Continued)

FOREIGN PATENT DOCUMENTS

| | | | |
|---|---|---|---|
| CN | 101357533 | A | 2/2009 |
| CN | 101513804 | A | 8/2009 |

(Continued)

*Primary Examiner* — Kristal Feggins
*Assistant Examiner* — Alexander D Shenderov
(74) *Attorney, Agent, or Firm* — Laurence A. Greenberg; Werner H. Sterner; Ralph E. Locher

(57) ABSTRACT

A printing machine includes an inkjet printing head having separately controllable nozzles for applying ink to a transported printing material, a radiation drier having radiation sources for generating electromagnetic radiation to at least partly dry and/or cure the applied ink on the transported printing material and at least one light trap disposed between the inkjet printing head and the radiation drier in such a way that the light trap forms a barrier for reflected and/or scattered radiation, thus protecting the inkjet printing head from radiation. The light trap includes at least one channel connected to an aspiration device for aspirating contaminated ambient air through the channel and reducing or preventing contamination of the radiation drier.

10 Claims, 7 Drawing Sheets

(56) References Cited

U.S. PATENT DOCUMENTS

| | | | | |
|---|---|---|---|---|
| 10,144,209 | B2 | 12/2018 | Franz et al. | |
| 2008/0079792 | A1* | 4/2008 | Hirato | B41J 2/17556 347/92 |
| 2009/0073232 | A1 | 3/2009 | Nakata et al. | |
| 2014/0368590 | A1* | 12/2014 | Shima | B41J 11/0015 347/102 |

FOREIGN PATENT DOCUMENTS

| | | | |
|---|---|---|---|
| CN | 102046387 | A | 5/2011 |
| CN | 104661825 | A | 5/2015 |
| CN | 104859304 | A | 8/2015 |
| CN | 105479942 | A | 4/2016 |
| CN | 106004083 | A | 10/2016 |
| CN | 107548359 | A | 1/2018 |
| CN | 107696694 | A | 2/2018 |
| DE | 102013209908 | A1 | 12/2013 |
| DE | 102015215335 | A1 | 4/2016 |
| DE | 102018210836 | A1 | 2/2019 |
| JP | S52150037 | A | 12/1977 |
| JP | S60184851 | A | 9/1985 |

* cited by examiner

PRINTING MACHINE WITH AN INKJET PRINTING HEAD, A RADIATION DRIER AND AT LEAST ONE LIGHT TRAP

CROSS-REFERENCE TO RELATED APPLICATION

This application claims the priority, under 35 U.S.C. § 119, of German Patent Application DE 10 2018 212 730.1, filed Jul. 31, 2018; the prior application is herewith incorporated by reference in its entirety.

BACKGROUND OF THE INVENTION

Field of the Invention

The invention relates to a printing machine having an inkjet printing head including separately controllable nozzles for applying ink to a transported printing material, a radiation drier including radiation sources for generating electromagnetic radiation to at least partly dry and/or cure the applied ink on the transported printing material, and at least one light trap disposed between the inkjet printing head and the radiation drier and forming a barrier for reflected and/or scattered radiation in order to protect the inkjet printing head from the radiation.

The technical field of the invention is the graphic industry, in particular the field of applying ink and drying and/or curing the applied ink.

In the field of drying and/or curing ink, it has become known to use final driers that dry (for instance by evaporating water) and/or cure (for instance by polymerization) the ink after the printing operation and before any further treatment. Moreover, when multiple printing heads are used in the printing operation, it has furthermore become known to use so-called intermediate driers between the printing heads to dry/cure the ink. That is referred to as "pinning." Both final driers and intermediate driers may get dirty and may need cleaning from time to time. For instance, it has become known to remove a UV drier and its protective glass screen through a lateral opening in the machine for cleaning purposes. It is furthermore known to reduce or avoid potential contamination of the drier by aspirating ink mist using an aspiration device that is separate from the printing head.

A problem that may occur in the prior art is that the removal of the components to be cleaned from the machine is a complex process and therefore takes a lot of time. When a dryer is cleaned within the machine, however, another problem may occur: the cleaning operation may be inadequate or advantageous cleaning operations such as ultrasound cleaning may even be impossible to carry out at all. The aforementioned disadvantages may result in further disadvantages: for instance, inadequate cleaning operations may result in a failure of the drier.

SUMMARY OF THE INVENTION

It is accordingly an object of the invention to provide a printing machine with an inkjet printing head, a radiation drier and at least one light trap, which overcomes the hereinafore-mentioned disadvantages of the heretofore-known devices of this general type in which, in particular, contamination of a radiation drier is reduced or avoided and in which potential contamination may be removed quickly and adequately.

Advantageous and thus preferred further developments of the invention will become apparent from the dependent claims as well as from the description and drawings. The features of the invention, of the further developments of the invention, and of the exemplary embodiments of the invention may be combined with one another and such combinations also represent advantageous further developments of the invention.

With the foregoing and other objects in view there is provided, in accordance with the invention, a printing machine with an inkjet printing head, a radiation drier and at least one light trap, the inkjet printing head including separately controllable nozzles for applying ink to a transported printing material, the radiation drier including radiation sources for generating electromagnetic radiation to at least partly dry (for instance by evaporating water from the ink and/or from the printing material) and/or cure (for instance by polymerizing the ink) the applied ink on the transported printing material, and the light trap being disposed between the inkjet printing head and the radiation drier in such a way that the light trap forms a barrier for reflected and/or scattered radiation, thus protecting the inkjet printing head from radiation. According to the invention, the light trap includes at least one channel that is connected to an aspiration device and through which contaminated ambient air may be aspirated.

The invention advantageously provides a way to reduce/avoid contamination of a radiation drier. Further advantages of the invention include that potential contamination may be removed quickly and adequately and that the device may be of very compact construction and be able to be connected and disconnected in an automated way.

Another preferred development of the invention may be that the channel is constructed as a through-hole. More than one channel/through-hole may be provided. The channels may be oriented to be substantially perpendicular to the plane of the light trap. The holes may be drilled holes.

A further preferred development of the invention may be that the light trap is disposed on a frame and the frame is disposed on the radiation drier. The frame may simplify the mounting and dismounting of the light trap.

An added preferred development of the invention may be that the light trap or the frame includes a further channel or that the light trap and the frame form a further channel that is disposed between the channel and the aspiration device in such a way that aspirated ambient air passes from the channel to the further channel and from there to the aspiration device. This configuration provides a compact construction.

An additional preferred development of the invention may be that the frame has a fixed coupling element of a coupling of the aspiration device. This coupling element may be coupled to a second coupling element of the coupling by lowering the radiation drier and may be decoupled by lifting the radiation drier. In this way, the coupling operation may be achieved through the drive for moving the drier (or the printing head if the drier is moved together with the printing head) and no additional drive is required.

Another preferred development of the invention may be that the light trap may be dismounted from the radiation drier together with the frame. This construction allows the mounting and dismounting to be simplified for the operator.

A further preferred development of the invention may be that a plate, such as a glass plate that is transparent to the radiation, is fixed to the frame. This construction allows the mounting and dismounting to be simplified for the operator and the light trap (or multiple light traps) and the plate may be taken out of the machine together with the frame.

An additional preferred development of the invention may be that a further light trap is provided and that the light trap is disposed upstream of the plate and the further light trap is disposed downstream of the plate in the direction of transport of the printing material. The upstream light trap and the channel thereof may aspirate ink mist, for instance. The downstream light trap and the channel thereof may aspirate vapors, for instance.

Another preferred development of the invention may be that two additional aspiration channels are provided and that in the direction of transport of the printing material, one of the additional aspiration channels is disposed upstream of the light trap while the other additional aspiration channel is disposed downstream of the further light trap. This construction is advantageous in the case of intermediate driers disposed downstream of printing heads for white ink or other ink with a large amount of evaporation during the drying/curing operation.

A further preferred development of the invention may be that the radiation drier is constructed as an LED drier generating UV radiation.

A concomitant development of the invention may be that the radiation drier is an intermediate drier for pinning UV-curable ink.

Other features which are considered as characteristic for the invention are set forth in the appended claims.

Although the invention is illustrated and described herein as embodied in a printing machine with an inkjet printing head, a radiation drier and at least one light trap, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
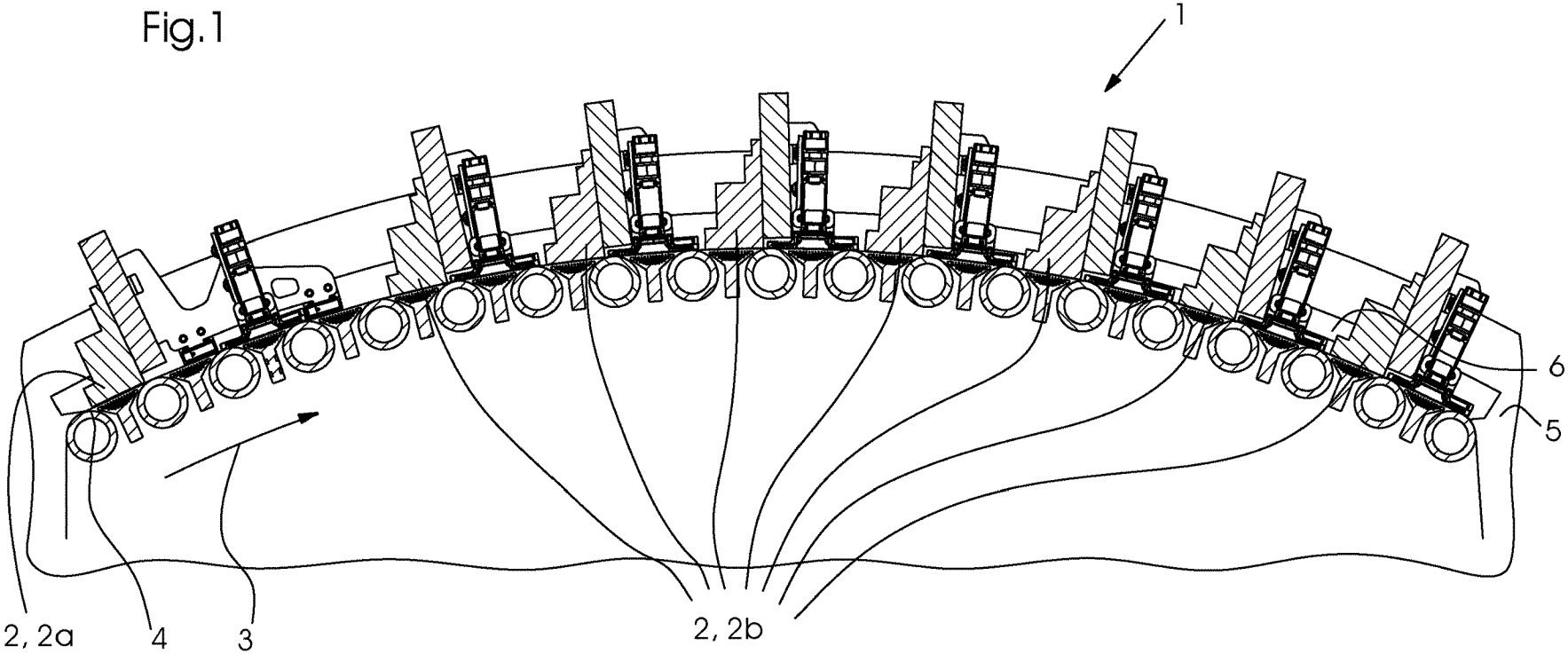
FIG. 1 is a fragmentary, diagrammatic, cross-sectional view of a preferred embodiment of a printing machine according to the invention.

Referring now in detail to the figures of the drawings, in which features that correspond to one another have the same reference symbol, and first, particularly, to FIG. 1 thereof, there is seen a lateral cross-sectional view of a preferred embodiment of a printing machine 1, in particular an inkjet printing machine 1 including multiple inkjet printing heads 2. One inkjet printing head 2*a* (or rather a printing unit including such an inkjet printing head) is provided for printing white ink (opaque white) and, downstream in a direction of transport 3 of a printing material 4, in particular a web, for instance a web of paper or plastic film, multiple inkjet printing heads 2*b* (or rather printing units including such inkjet printing heads) are provided for printing black ink and/or chromatic inks such as the known colors K CMY OGV. The inkjet printing heads 2 are supported at least in an operator-side side wall 5 of the machine 1 so as to be movable up and down (by using non-illustrated drives). The side wall has an opening 6. Each one of the inkjet printing heads preferably includes a nozzle plate with a plurality of individually controllable nozzles for jetting ink drops.

Figure 2:
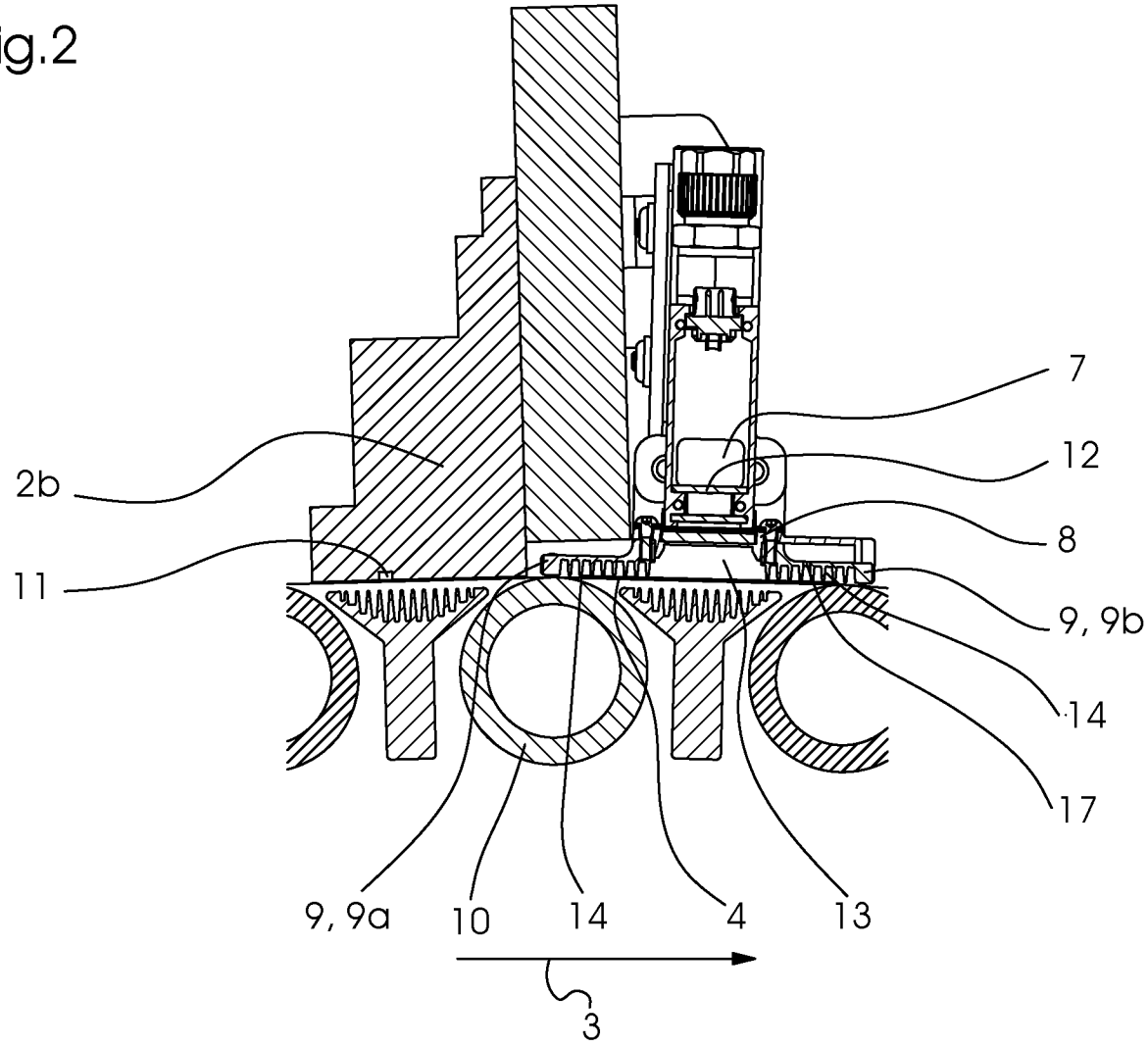
FIG. 2 is an enlarged, cross-sectional view of a portion of FIG. 1.

FIG. 2 illustrates a section of FIG. 1 in the region of an inkjet printing head 2*b*. A radiation drier 7 (referred to as a drier for short) is disposed in the vicinity of the inkjet printing head. The drier 7 is preferably disposed on, e.g. fixed to, the inkjet printing head or an inkjet printing head mount, and is preferably movable up and down together with the inkjet printing head. The figure also shows that a frame 8 is disposed on the drier and a light trap 9, or preferably first and second light traps 9*a* and 9*b*, is/are disposed on the frame 8. The printing head 2, the drier 7 and the light traps 9*a* and 9*b* extend in a direction substantially transverse to the direction of transport 3 and across the width of the printing material 4. The radiation drier is constructed as a so-called intermediate drier and is preferably used to partly dry (i.e. to pin) UV-curable ink. The figure further shows the printing material 4 and deflection rollers 10 for the printing material.

The inkjet printing head 2 may include multiple printing heads and may in particular be a so-called print bar. It preferably includes a plurality of nozzles 11 for applying the ink. The radiation drier 7 includes several radiation sources 12, preferably LEDs, especially UV LEDs for generating electromagnetic radiation 13, preferably UV radiation.

Each one of the light traps 9*a* and 9*b* preferably includes multiple protruding barriers 14 (protruding from a support surface or the plane thereof), in particular ribs, for the radiation 13 that is reflected and/or scattered by the printing material 4 and/or by printing machine elements disposed opposite the light traps. Thus, the light traps may preferably be ribbed. The sectional view of FIG. 2 shows that the light trap may have a comb-shaped cross-section (parallel to the direction of transport 3). Reflected and/or scattered radiation is reflected back from by the individual segments of the light trap (and thus away from the printing head 2*b*). Reflected and/or diffracted radiation may additionally be absorbed by the light trap.

The figure shows that the radiation drier 7 is very close to the associated inkjet printing head 2. Therefore, it is advantageous if the light traps 9, in particular the light trap 9*a*, prevents reflected and/or scattered radiation 13 from reaching the nozzles 11, where it would cure the ink and thus cause damage to the inkjet printing head 2.

Figure 3:
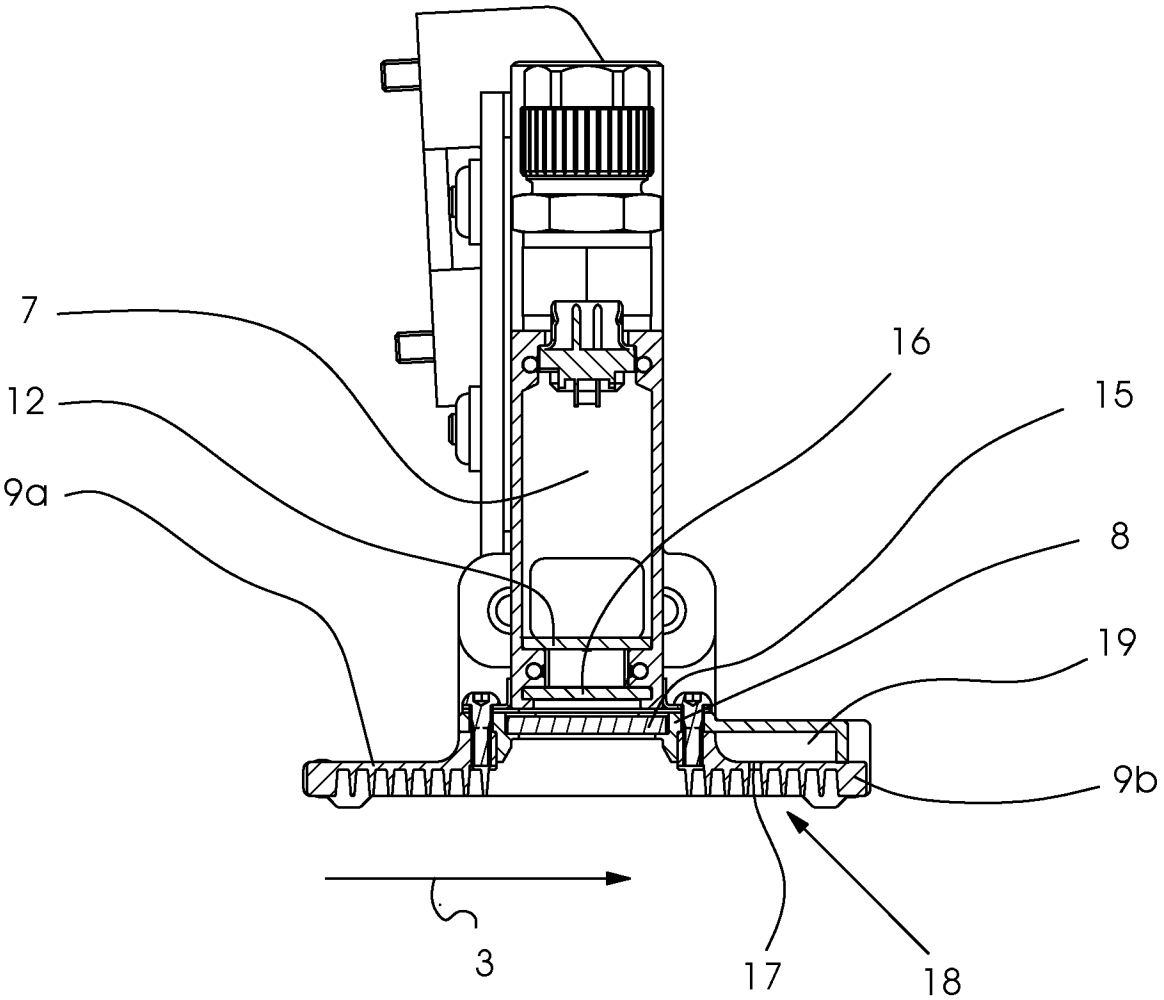
FIG. 3 is a cross-sectional view of a radiation drier, a frame and two light traps in accordance with the invention as shown in FIG. 1.

FIG. 3 is a sectional view of the radiation drier 7, the frame 8 and the light traps 9/9*a* and 9*b*. The frame carries a plate 15, which is transparent to the radiation 13, preferably a glass plate. This prevents contamination of the radiation drier 7 and of its own glass plate 16 caused by deposition of ink mist or vapors. Thus, the structure preferably includes two glass plates, one of which may be removed from the machine 1 to be cleaned.

FIG. 3 also shows that the light trap 9*b* includes an (integrated) channel 17 ("vertical" first channel), which may be a through-hole (in the support surface of the light trap/the plane thereof) ending between two barriers, in particular ribs. There may be a plurality of channels that are, for instance, spaced apart from one another in the lateral direction (transverse to the direction of transport 3) and/or in the longitudinal direction (parallel to the direction of transport 3).

The channel 17 is connected to an aspiration device 24 (see FIG. 6) so that contaminated ambient air 18 may be aspirated through the channel. The contamination may be caused by ink mist and/or vapors emanating from the drying and/or curing (polymerizing) ink. The intention is to prevent such contamination from settling on the light trap 9 or on the drier 7 to reduce the required cleaning effort.

Together with the light trap 9*b*, the frame 8 shown in FIG. 3 forms a further channel 19 ("horizontal" second channel). The ambient air 18 is aspirated through the channel 17 and into the further channel 19 and then guided to the aspiration device 24. Together, the two channels form a channel system.

Figure 4:
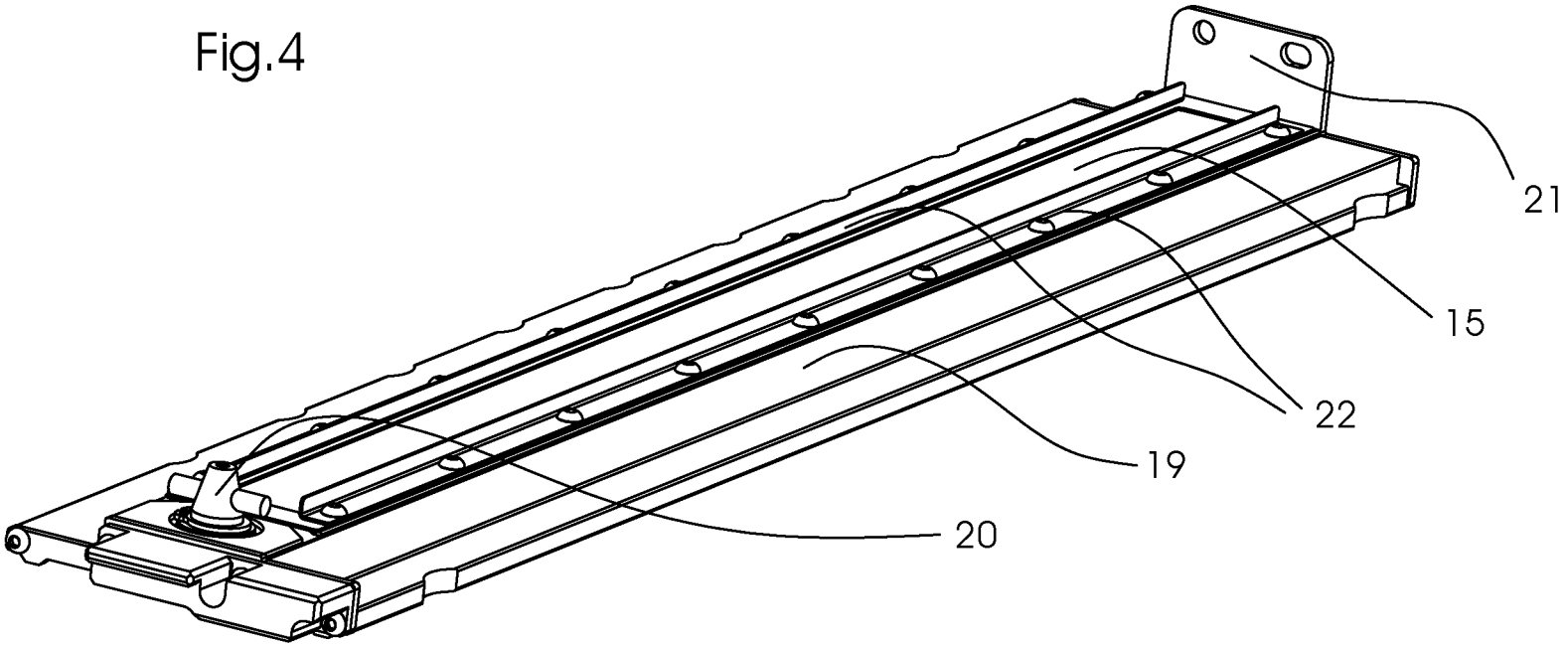
FIG. 4 is a top perspective view of the frame and light trap of FIG. 3.

FIG. 4 is a perspective view of the embodiment of FIG. 3, i.e. of the frame 8 and the light traps 9 (now in a view from above). The frame and with it the light traps 9 are easy to disassemble from the radiation drier 7. This allows the light traps to be cleaned outside the printing machine 1.

For instance, an inkjet printing head 2 may be moved "upward" (into a standby position that is different from the printing position). The radiation drier 7, the frame 8 and the light traps 9 may be moved together with the printing head. In this way, space for disassembly is created between the radiation drier and the printing material 4. The frame and light traps may be removed through the lateral opening 6 (see FIG. 1), for instance. A locking mechanism 20 is opened in the disassembling process, preferably by hand. Then the frame is pivoted downward on the operator side and its mount 21 is disassembled on the drive side. Now the frame may be taken out of the machine.

A dismounted frame 8 with the light traps 9 and the glass plate 15 (which together provide a "protective device") may be cleaned outside the printing machine 1, for instance by using an ultrasound cleaning device (ultrasound bath). During the cleaning process, the printing machine 1 may preferably be operated with a replacement protective device to avoid long periods of standstill.

Figure 5:
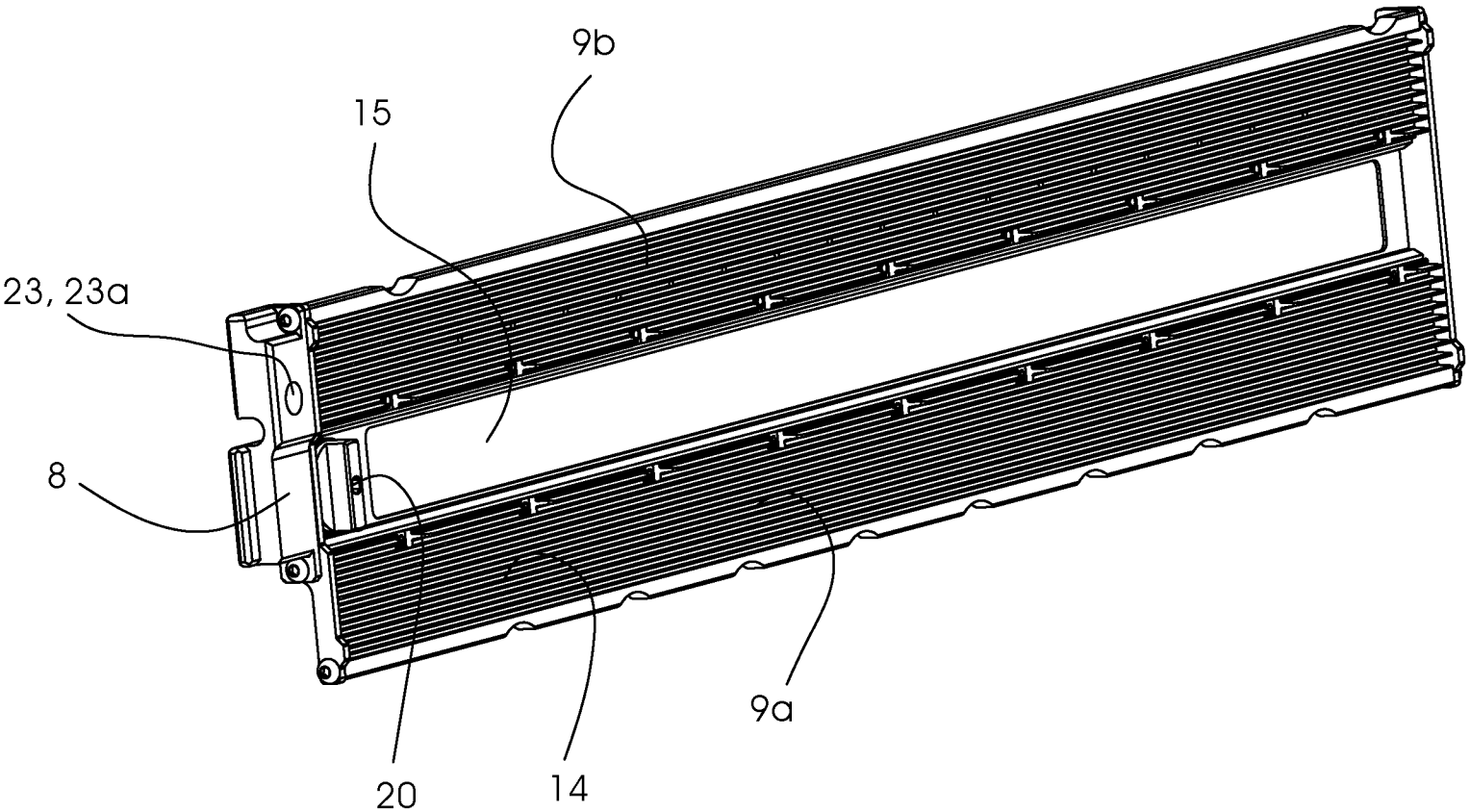
FIG. 5 is a further, bottom perspective view of the frame and light traps of FIG. 3.

FIG. 5 is a further perspective view of the embodiment of FIG. 3 (in a view from "below"). The elements that can be seen are the frame 8, the two light traps 9*a* and 9*b* with the protruding barriers 19 and the glass plate 15. Another element that is shown is a first coupling element 23*a* of a coupling 23 of the aspiration device 24 (see FIG. 6), and finally the locking mechanism 20 or a latch.

Figure 6:
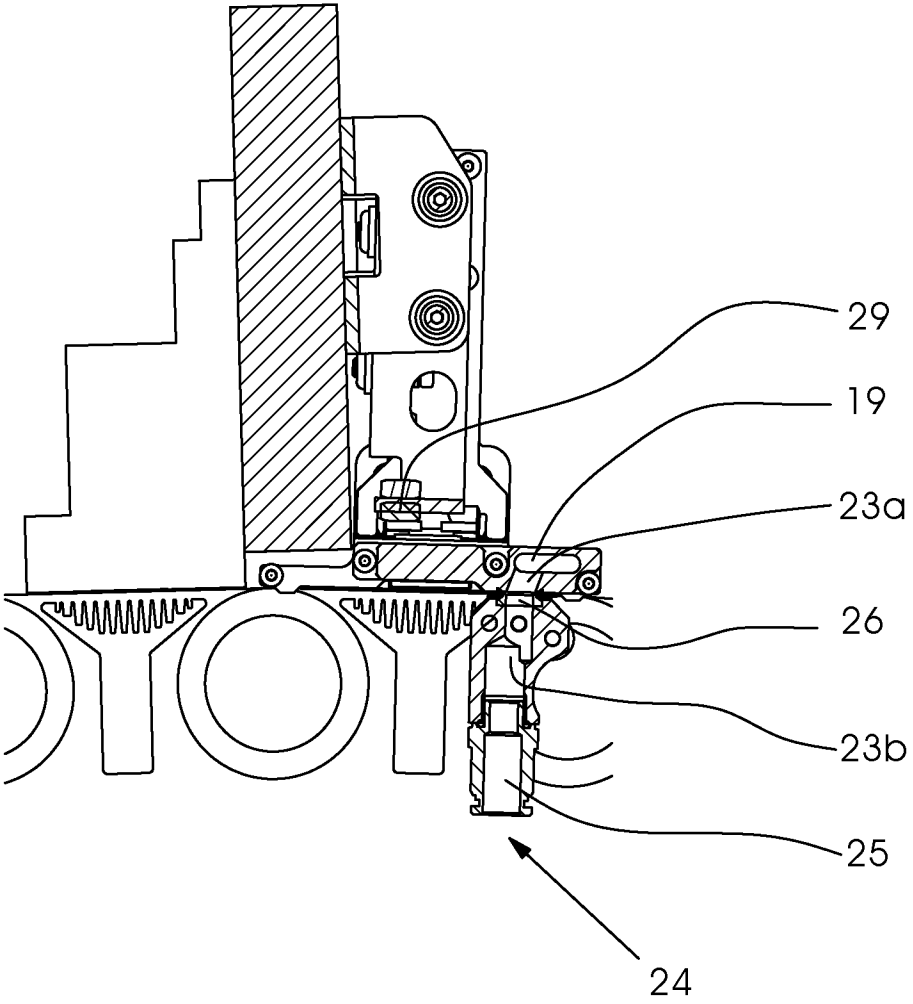
FIG. 6 is a perspective, cross-sectional view of the aspiration device of FIG. 1 in accordance with the invention.

FIG. 6 is a perspective view of the aspiration device 24, which includes the first coupling element 23*a* and a second coupling element 23*b* of the coupling 23 as well as a conduit 25 such as a hose, which preferably leads to a non-illustrated pump (including a valve and a separator). A seal 26 is provided between the two coupling elements. When the radiation drier 7 and the frame 8 are lifted, a decoupling action occurs (separation of the two coupling elements) and when they are lowered, a coupling action occurs (connection of the two coupling elements).

FIG. 6 shows a sensor 29, which detects the frame 8 and/or the light traps 9, i.e. it detects the respective disassembled condition and prevents the machine from being operated, i.e. from printing, in this condition—or vice versa.

Figure 7:
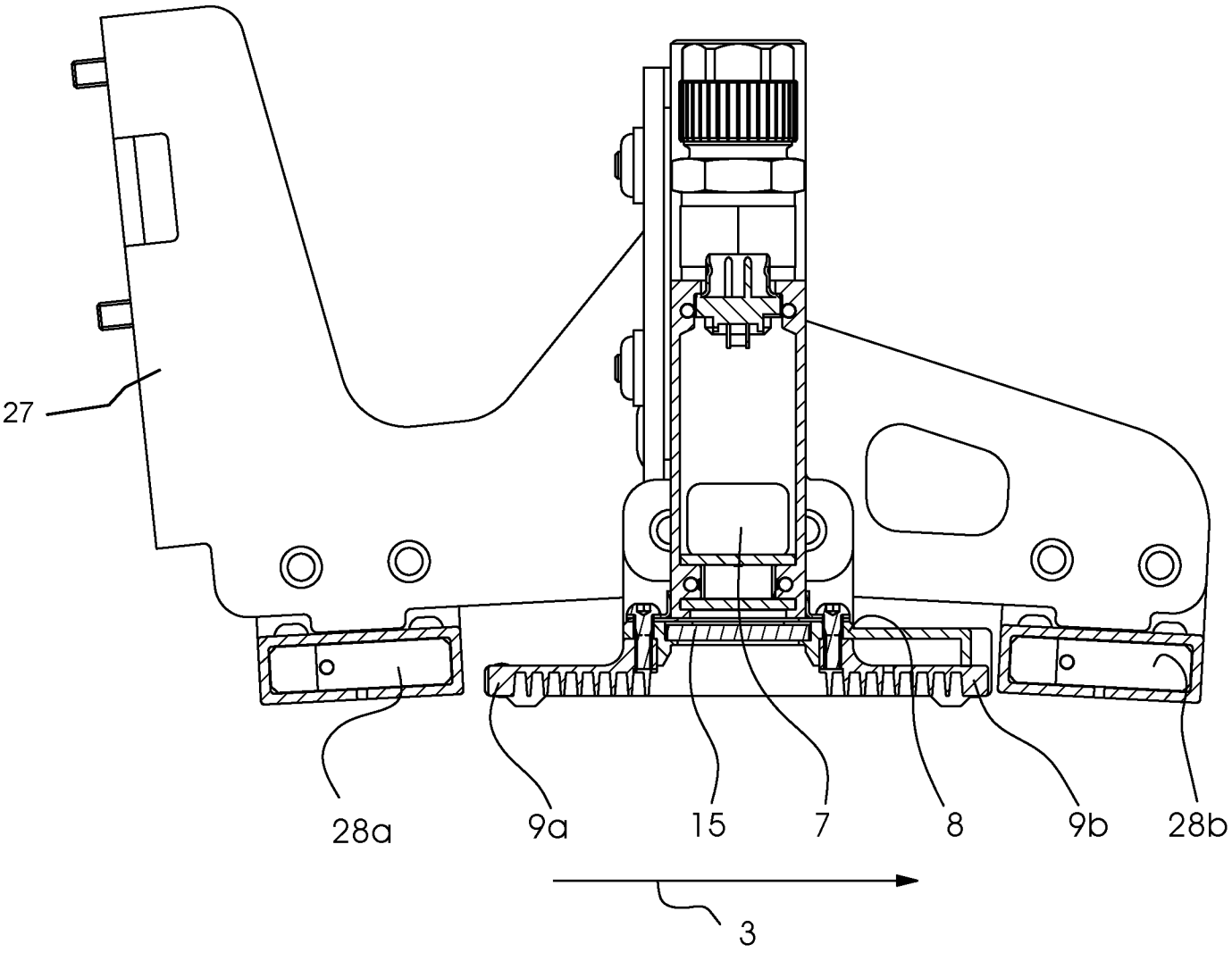
FIG. 7 is a cross-sectional view of a further preferred embodiment of the invention shown in FIG. 1.

FIG. 7 illustrates a further embodiment of the invention, wherein the radiation drier 7 is supported on a carrier 27 together with the frame 8 and the light trap 9. Moreover, two additional (preferably horizontal) aspiration channels 28*a* and 28*b* are disposed on the carrier. The channels include a channel 28*a* upstream of the light trap 9*a* (preferably for aspirating ink mist) and another channel 28*b* (preferably for aspirating ink vapors) downstream of the light trap 9*b*. The aforementioned locations refer to the direction of transport 3. The two additional aspiration channels are preferably connected to the aspiration device 24 by their own couplings.

This embodiment is used in particular in the printing unit for white ink because there, the performance requirements for the aspiration device in terms of aspirating ink mist and vapors are particularly high due to the large amount of ink that is applied. Further channels 17 for increasing the aspiration power of the respective aspiration channels may preferably be provided for this purpose.

An intermediate drier downstream of a printing head 2*a* may preferably be operated at more than 10 watts/cm$^2$, for instance. An intermediate drier downstream of a printing head 2*b* may preferably be operated at less than 10 watts/cm$^2$, for instance.

The light traps 9 may have a coating that absorbs the radiation 13, for instance a black coating.

The following is a summary list of reference numerals and the corresponding structure used in the above description of the invention.

LIST OF REFERENCE SYMBOLS

1 printing machine
2 inkjet printing heads
2*a* inkjet printing heads for white ink
2*b* inkjet printing heads for black and/or chromatic ink
3 direction of transport
4 printing material
5 side wall
6 opening
7 radiation drier
8 frame
9 light trap
9*a*, 9*b* light traps
10 deflection rollers
11 nozzles
12 radiation sources
13 radiation
14 barriers
15 glass plate
16 glass plate
17 channel
18 ambient air
19 further channel
20 locking mechanism
21 mount
22 covers
23 coupling
23*a* first coupling element of the coupling
23*b* second coupling element of the coupling
24 aspiration device
25 conduit
26 seal
27 carrier
28*a*, 28*b* additional aspiration channels
29 sensor

The invention claimed is:

1. A printing machine, comprising:

an inkjet printing head including separately controllable nozzles for applying ink to a transported printing material;

a radiation drier including radiation sources for generating electromagnetic radiation to at least partly carry out at least one of drying or curing of the applied ink on the transported printing material;

an aspiration device;

at least one light trap disposed between said inkjet printing head and said radiation drier, said at least one light trap forming a barrier for at least one of reflected or scattered light radiation to protect said inkjet printing head from light radiation, said at least one light trap having at least one channel connected to said aspiration device for aspirating contaminated ambient air through said at least one channel; and a frame disposed on said radiation drier, said at least one light trap being disposed on said frame.

2. The printing machine according to claim 1, wherein said at least one channel is a through-hole.

3. The printing machine according to claim 1, wherein:

said at least one channel is a first channel;

said at least one light trap includes a second channel; and said second channel is disposed between said first channel and said aspiration device for guiding the aspirated ambient air from said first channel into said second channel and from said second channel to said aspiration device.

4. The printing machine according to claim 1, wherein:

said at least one channel is a first channel;

said frame includes a second channel or said at least one light trap and said frame form a second channel; and said second channel is disposed between said first channel and said aspiration device for guiding the aspirated ambient air from said first channel to said second channel and from said second channel to said aspiration device.

5. The printing machine according to claim 1, wherein:

said frame includes a coupling of said aspiration device;

said coupling includes a first coupling element and a second coupling element; and said first coupling element being configured to be coupled to said second coupling element by a lowering motion of said radiation drier and said first coupling element being configured to be uncoupled from said second coupling element by a lifting motion of said radiation drier.

6. The printing machine according to claim 1, wherein said at least one light trap is configured to be disassembled from said radiation drier together with said frame.

7. The printing machine according to claim 1, which further comprises a plate being transparent to the radiation and being disposed on said frame.

8. The printing machine according to claim 7, wherein:

said at least one light trap is a first light trap disposed upstream of said plate in a transport direction of the printing material; and a second light trap is disposed downstream of said plate.

9. The printing machine according to claim 8, which further comprises one additional aspiration channel disposed upstream of said first light trap in the printing material transport direction, and another additional aspiration channel disposed downstream of said second light trap in the printing material transport direction.

10. A printing machine, comprising:

an inkjet printing head including separately controllable nozzles for applying ink to a transported printing material;

a radiation drier including radiation sources for generating electromagnetic radiation to at least partly carry out at least one of drying or curing of the applied ink on the transported printing material, said radiation drier being an intermediate LED drier generating UV radiation for pinning UV-curable ink;

an aspiration device; and at least one light trap disposed between said inkjet printing head and said radiation drier, said at least one light trap forming a barrier for at least one of reflected or scattered light radiation to protect said inkjet printing head from light radiation, said at least one light trap having at least one channel connected to said aspiration device for aspirating contaminated ambient air through said at least one channel.

* * * * *